US007648061B2

(12) United States Patent
Zammit et al.

(10) Patent No.: US 7,648,061 B2
(45) Date of Patent: Jan. 19, 2010

(54) CARTON WITH DISPENSER

(75) Inventors: Mark Zammit, Hiram, GA (US); Charles F. Ho Fung, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 130 days.

(21) Appl. No.: 11/767,169

(22) Filed: Jun. 22, 2007

(65) Prior Publication Data

US 2007/0295792 A1 Dec. 27, 2007

Related U.S. Application Data

(60) Provisional application No. 60/816,108, filed on Jun. 23, 2006.

(51) Int. Cl.
*B65D 17/28* (2006.01)

(52) U.S. Cl. ..... 229/240; 229/122; 229/242

(58) Field of Classification Search ..... 229/122, 229/240, 242; 206/427; 221/302, 305
See application file for complete search history.

(56) References Cited

U.S. PATENT DOCUMENTS 2,754,047 A * 7/1956 Schmidt et al. ..... 206/427
3,002,613 A * 10/1961 Merkel et al. ..... 229/240
3,904,036 A * 9/1975 Forrer ..... 206/427
6,209,786 B1 * 4/2001 Yelton et al. ..... 229/240
6,283,293 B1 9/2001 Lingamfelter
6,604,677 B1 8/2003 Sutherland et al.
6,669,083 B2 12/2003 Bates
6,997,316 B2 * 2/2006 Sutherland ..... 221/305
7,328,798 B2 * 2/2008 Auclair et al. ..... 229/122
2002/0185527 A1 12/2002 Bates
2003/0234285 A1 12/2003 Bates et al.
2004/0154945 A1 8/2004 Harrelson
2004/0188277 A1 9/2004 Auclair
2005/0189405 A1 9/2005 Gomes et al.
2007/0114151 A1 * 5/2007 Auclair ..... 206/427

FOREIGN PATENT DOCUMENTS

GB 2 300 853 A 11/1996
WO WO 2006/052537 A1 5/2006
WO WO 2006/053327 A1 5/2006

* cited by examiner

*Primary Examiner*—Gary E Elkins
(74) *Attorney, Agent, or Firm*—Womble Carlyle Sandridge & Rice, PLLC

(57) ABSTRACT

A carton includes a dispenser that when opened allows dispensing of containers from the carton. An aperture located next to the dispenser provides access to the dispenser and allows the containers to be viewed from the carton exterior.

17 Claims, 6 Drawing Sheets

CARTON WITH DISPENSER

PRIORITY APPLICATION

This application claims the benefit of U.S. Provisional Application No. 60/816,108, filed Jun. 23, 2006, which is hereby incorporated by reference in its entirety.

BACKGROUND

Enclosed cartons with dispensing features have been used in the past. Many of these cartons include article dispensers defined by lines of disruption such as tear lines, cuts, score lines, and fold lines. A dispenser may be removable from a carton to create an opening from which articles can be removed from the carton. In many instances, access to the dispenser may be realized through breachable sections of the carton that allow a user finger access to the dispenser. Such breachable sections may be difficult to access and may not function reliably. Conventional cartons are also typically fully enclosed structures that do not allow consumers to view the product held within the carton.

SUMMARY

According to a first embodiment of the invention, a carton comprises a bottom panel, a first side panel, a second side panel, a top panel, an end panel, an exiting end panel, a dispenser pattern comprising breachable lines of disruption in the carton and defining a dispenser section, and an aperture in the carton. The aperture allows one or more of the articles in the carton interior to be viewed from an exterior of the carton.

According to one aspect of the invention, the aperture can be located adjacent to the dispenser section. The aperture provides access to an edge of the dispenser section so that a user can initiate removal of the dispenser section at the aperture.

According to another aspect of the invention, the size and shape of the aperture can be chosen to expose selected portions of one or more articles accommodated in the carton to view from the exterior of the carton.

Other aspects, features, and details of the present invention can be more completely understood by reference to the following detailed description of exemplary embodiments taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present invention generally relates to dispensers for cartons. The present invention can be used, for example, in cartons that contain articles or other products such as, for example, food and beverages. The articles can also include beverage containers such as, for example, cans, bottles, PET containers, or other containers such as those used in packaging foodstuffs. For the purposes of illustration and not for the purpose of limiting the scope of the present invention, the following detailed description describes generally cylindrical beverage containers as disposed within the carton embodiments. In this specification, the relative terms "side," "bottom," and "top" indicate orientations determined in relation to fully erected cartons.

Figure 1:
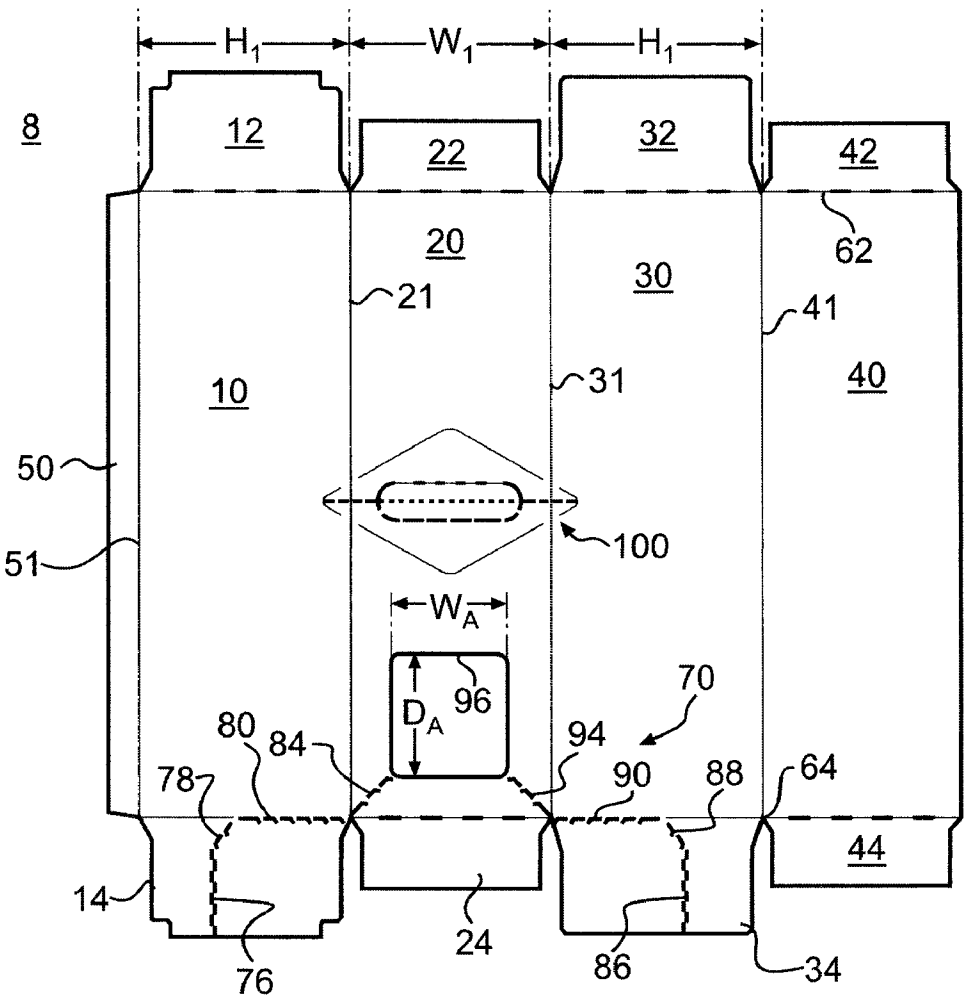
FIG. 1 is a plan view of a blank from which a carton according to a first embodiment of the invention is formed.

FIG. 1 is a plan view of the exterior or print side of a blank 8 used to form a carton 150 (illustrated in FIG. 2) according to a first embodiment of the invention. The blank 8 comprises a first side panel 10 foldably connected to a top panel 20 at a first transverse fold line 21, a second side panel 30 foldably connected to the top panel 20 at a second transverse fold line 31, and a bottom panel 40 foldably connected to the second side panel 30 at a third transverse fold line 41. An adhesive flap 50 may be foldably connected to the first side panel 10 at a fourth transverse fold line 51. Each of the panels 10, 20, 30, 40 has a generally rectangular plan shape.

The first side panel 10 is foldably connected to a first side end flap 12 and a first side exiting end flap 14. The top panel 20 is foldably connected to a top end flap 22 and a top exiting end flap 24. The second side panel 30 is foldably connected to a second side end flap 32 and a second side exiting end flap 34. The bottom panel 40 is foldably connected to a bottom end flap 42 and a bottom exiting end flap 44. The end flaps 12, 22, 32, 42 may extend along a first marginal area of the blank 8, and may be foldably connected along a first longitudinally extending fold line 62. The exiting end flaps 14, 24, 34, 44 may extend along a second or bottom marginal area of the blank 8, and may be foldably connected along a second longitudinally extending fold line 64. The longitudinally extending fold lines 62, 64 may be straight or substantially straight fold lines, or may be offset at one or more locations to account for, for example, blank thickness. When the carton 150 (illustrated in FIG. 2) is erected, the end flaps 12, 22, 32, 42 close one end of the carton 150, and the exiting end flaps 14, 24, 34, 44 close an access or exiting end of the carton 150.

Figure 2:
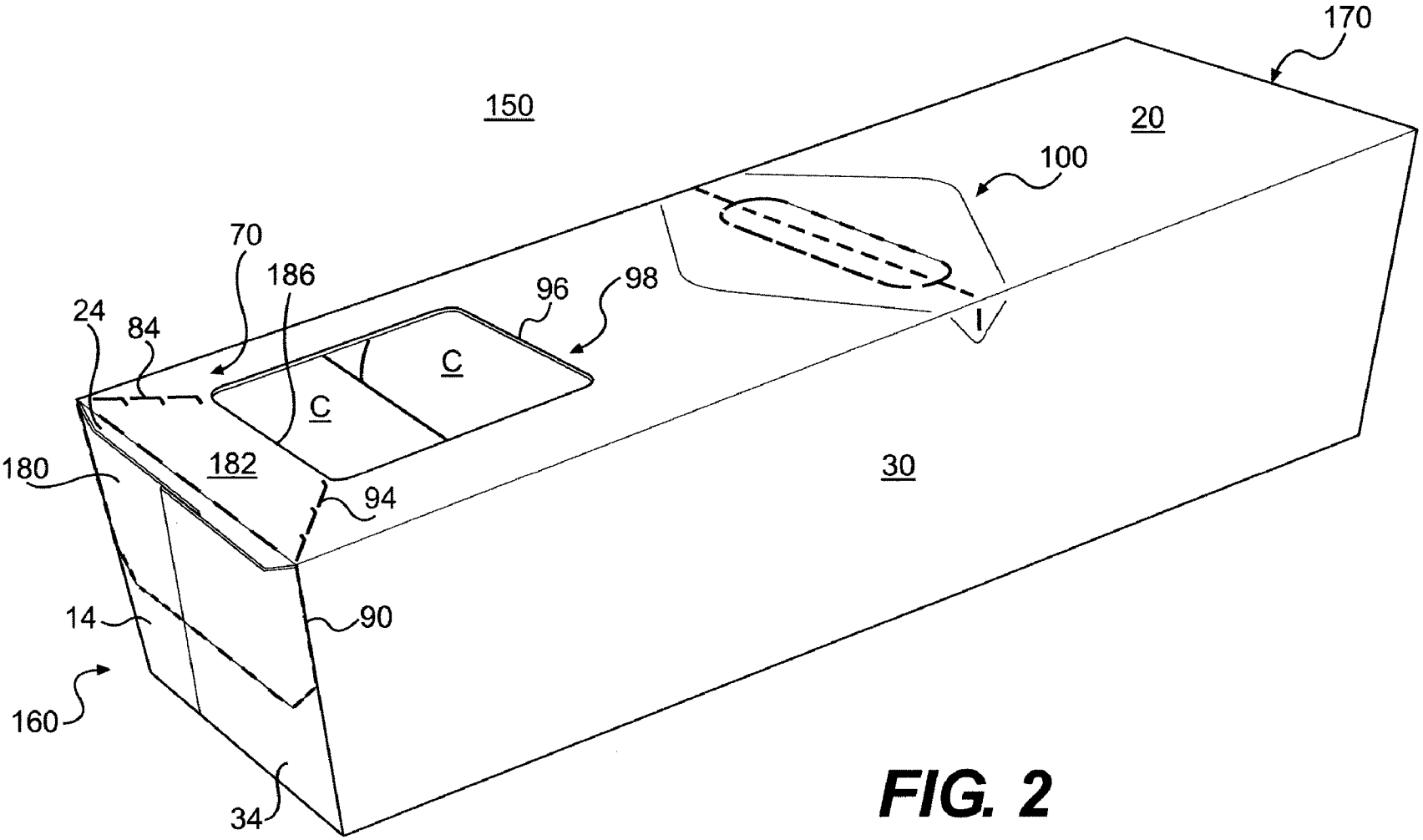
FIG. 2 illustrates the carton according to the first embodiment of the invention.

According to one aspect of the first embodiment of the invention, the blank 8 includes a dispenser pattern 70 comprised of breachable lines of disruption that define a dispenser 180 in the erected carton 150 (FIG. 2). According to another aspect of the first embodiment, a viewing and/or access aperture 96 is formed in the top panel 20 adjacent to the dispenser pattern 70. The access aperture 96 provides an opening 98 in the erected carton 150 through which a dispenser section 182 (FIG. 2) of the dispenser 180 can be accessed and/or articles accommodated in the carton 150 can be viewed.

Still referring to FIG. 1, the breachable lines of disruption of the dispenser pattern 70 comprise a first end tear line 76 that extends transversely through the first side exiting end flap 14 and a second end tear line 86 that extends transversely through the second side exiting end flap 34. The first end tear line 76 extends to a point at or adjacent to an oblique tear line 78 extending obliquely through the end flap 14, which in turn connects to a longitudinal tear line 80 extending along the longitudinal fold line 64. An oblique tear line 84 extends from the longitudinal tear line 80 to a point at or adjacent to a corner of the aperture 96. The second end tear line 86 extends to a point at or adjacent to an oblique tear line 88 extending obliquely through the end flap 34, which in turn extends to a point at or adjacent to a longitudinal tear line 90 extending along the longitudinal fold line 64. An oblique tear line 94 extends from the longitudinal tear line 90 at or adjacent to a corner of the aperture 96.

The tear lines 76, 78, 80, 84, 86, 88, 90, 94 of the dispenser pattern 70 can be, for example, breachable lines of disruption formed from continuous or substantially continuous tear lines formed from, for example, scores, creases, cuts, gaps, cut/creases, perforations, offset cuts, and overlapping and/or sequential combinations thereof. If cuts are used to form the tear lines 76, 78, 80, 84, 86, 88, 90, 94, the cuts may be, for example, interrupted by breachable nicks.

In the illustrated embodiment, the aperture 96 has a generally rectangular perimeter defined by a continuous cut, which defines a cutout section struck from the top panel 20. Alternatively, the perimeter of the viewing aperture 96 can be a cut interrupted by nicks, or a tear line, such that a removable knockout section (not shown) is formed in the top panel 20. Other perimeter shapes are also possible, as discussed in further detail below.

Still referring to FIG. 1, the dimensions of the blank 8 may be selected to accommodate characteristic dimensions of articles to be accommodated within the carton 150 (FIG. 2). For example, the top panel 20 can have a width $W_1$ that generally corresponds to or slightly exceeds a height of containers C (illustrated in FIG. 3) or other articles to be accommodated within the carton 150. When cylindrical or substantially cylindrical containers C are used, the first and second side panels 10, 30 can have, for example, a height $H_1$ that generally corresponds to or slightly exceeds an integral multiple of a largest or characteristic diameter of the containers C. For example, if the containers C are to be stacked in two rows in the carton 150, the height $H_1$ of the carton 150 can be about equal to or slightly greater than twice the containers' largest or characteristic diameter. If multiple generally cylindrical containers C, such as beverage containers, are to be accommodated in the carton, it may be expected that the containers will share at least one substantially equal common largest diameter.

An exemplary method of erection of the carton 150 is discussed below with reference to FIGS. 1 and 2.

Referring to FIG. 1, the carton 150 may be erected from the blank 8 by folding the blank flat at the transverse fold lines 21, 41 so that the adhesive flap 50 can be adhered to the inner side of the bottom panel 40. The bottom panel 40, the first side panel 10, the top panel 20, and the second side panel 30 may then be opened to a generally tubular form.

The exiting end of the generally tubular form may be closed, for example, by folding the end flaps 24 and 44 inwardly across the open exiting end, followed by folding the end flap 14, then folding the end flap 34 inwardly. The interior side of the end flap 14 can be adhered to the end flaps 24, 44, and the interior side of the end flap 34 can be adhered to one or more of the end flaps 14, 24, 44. The opposite or back end of the generally tubular form may be closed, for example, by folding the end flaps 22 and 42 across the open back end, followed by the end flap 12, then the end flap 32, and gluing one or more of the flaps 12, 22, 32, 42 together. Substantially cylindrical containers C or other articles, for example, may be loaded into the tubular sleeve in a conventional manner at any time before one or both ends of the carton are closed by the end flaps 12, 22, 32, 42, 14, 24, 34, 44.

FIG. 2 is a perspective view of the carton 150 erected from the blank 8 illustrated in FIG. 1. In the erected carton 150, the end flaps 12, 22, 32, 42 form an end panel 170 at one end of the carton and the exiting end flaps 14, 24, 34, 44 form an exiting end panel 160 at the opposite end. With the ends closed, the carton 150 has a substantially parallelepipedal shape. The dispenser pattern 70 defines a dispenser 180 having a dispenser section 182 that may be wholly or partially separated from a remainder of the carton 150 to place the carton in an open or dispensing configuration. Containers C within the carton 150 are visible through the opening 98 defined by the aperture 96. An edge 186 of the dispenser section 182 faces the aperture 96 in the top panel 20 and the dispenser section 182 is accessible thereby.

Figure 3:
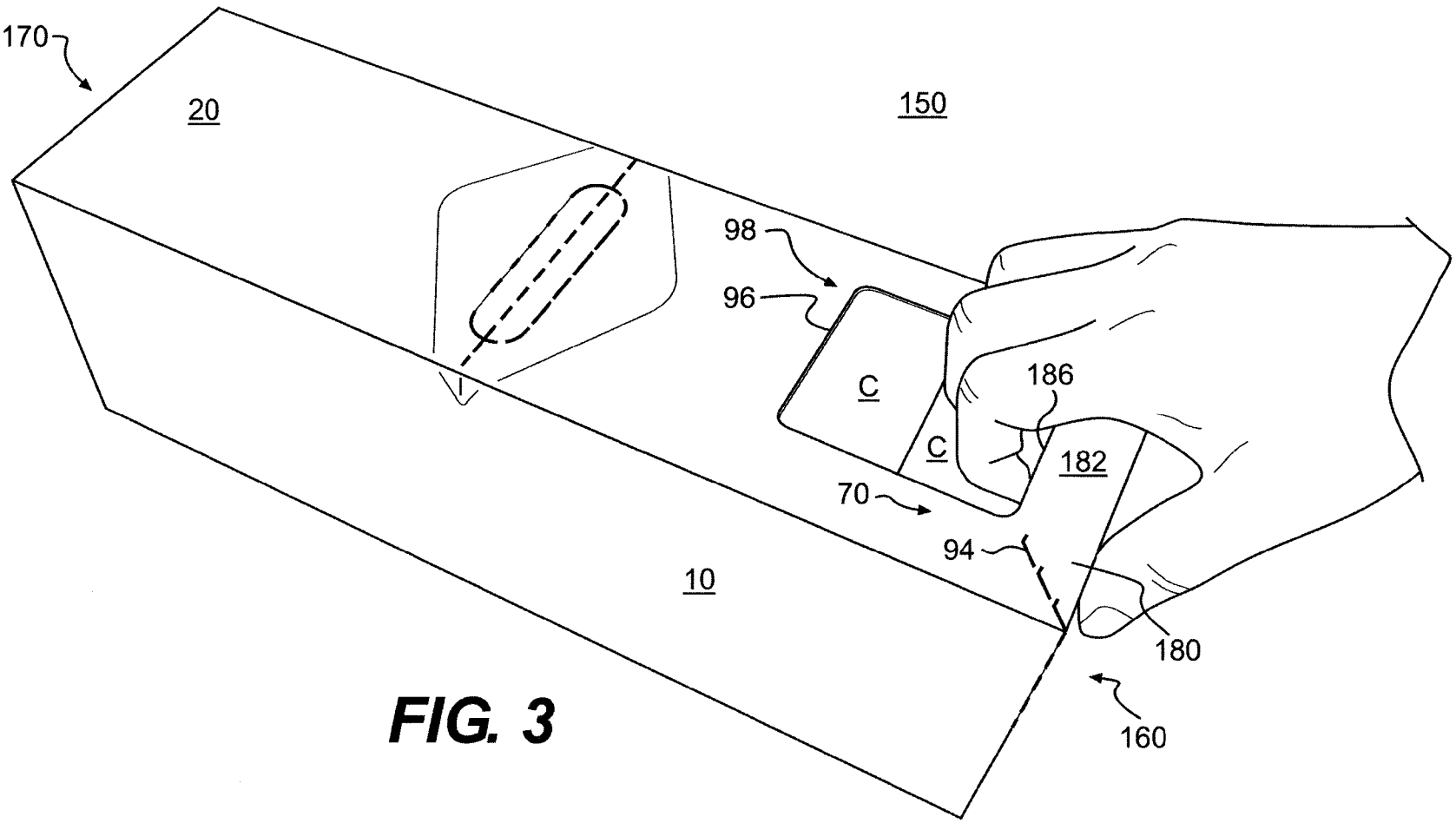
FIG. 3 illustrates opening of the dispenser of the first carton embodiment.
Figure 4:
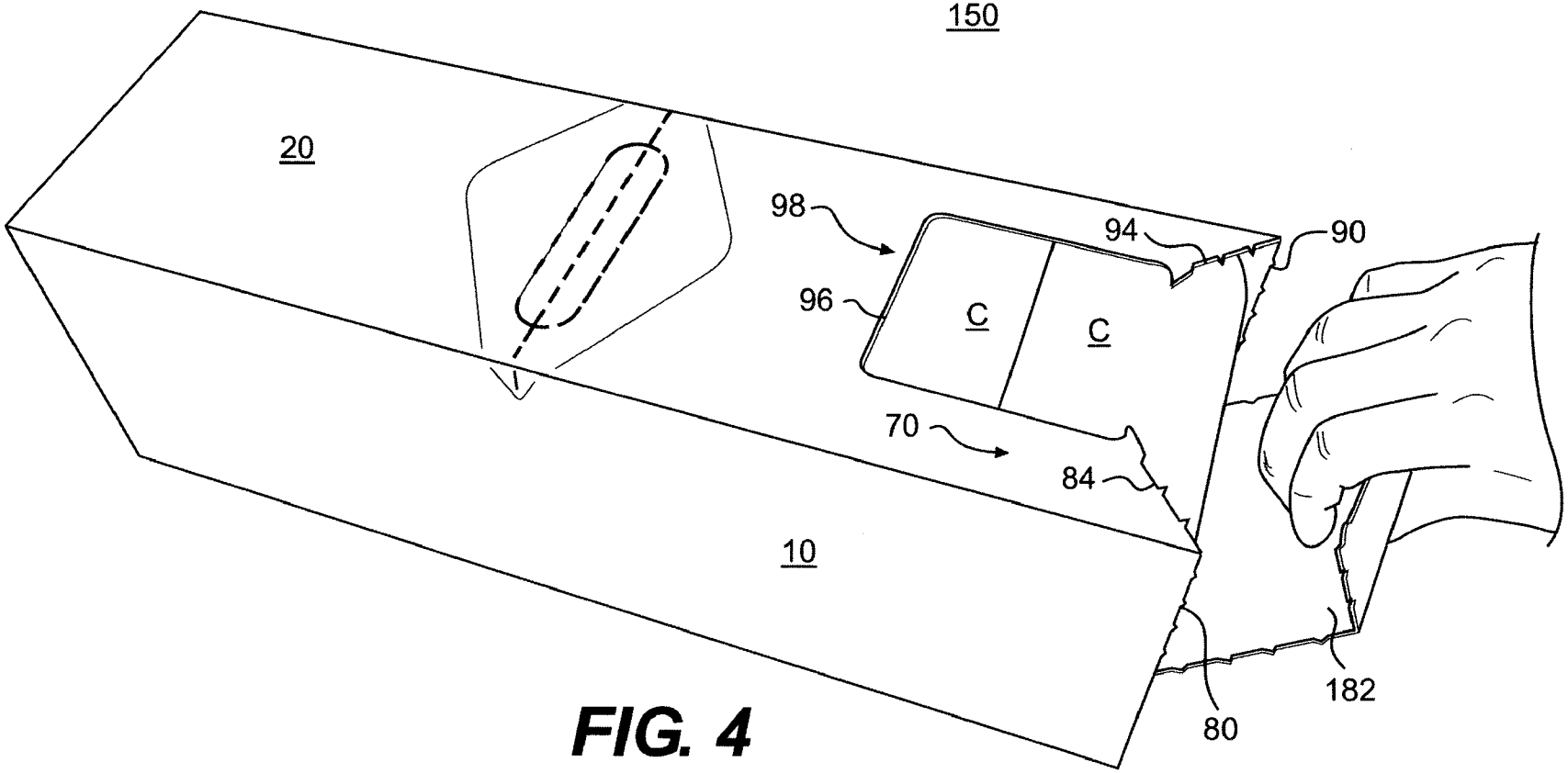
FIG. 4 illustrates further opening of the dispenser of the first carton embodiment.
Figure 5:
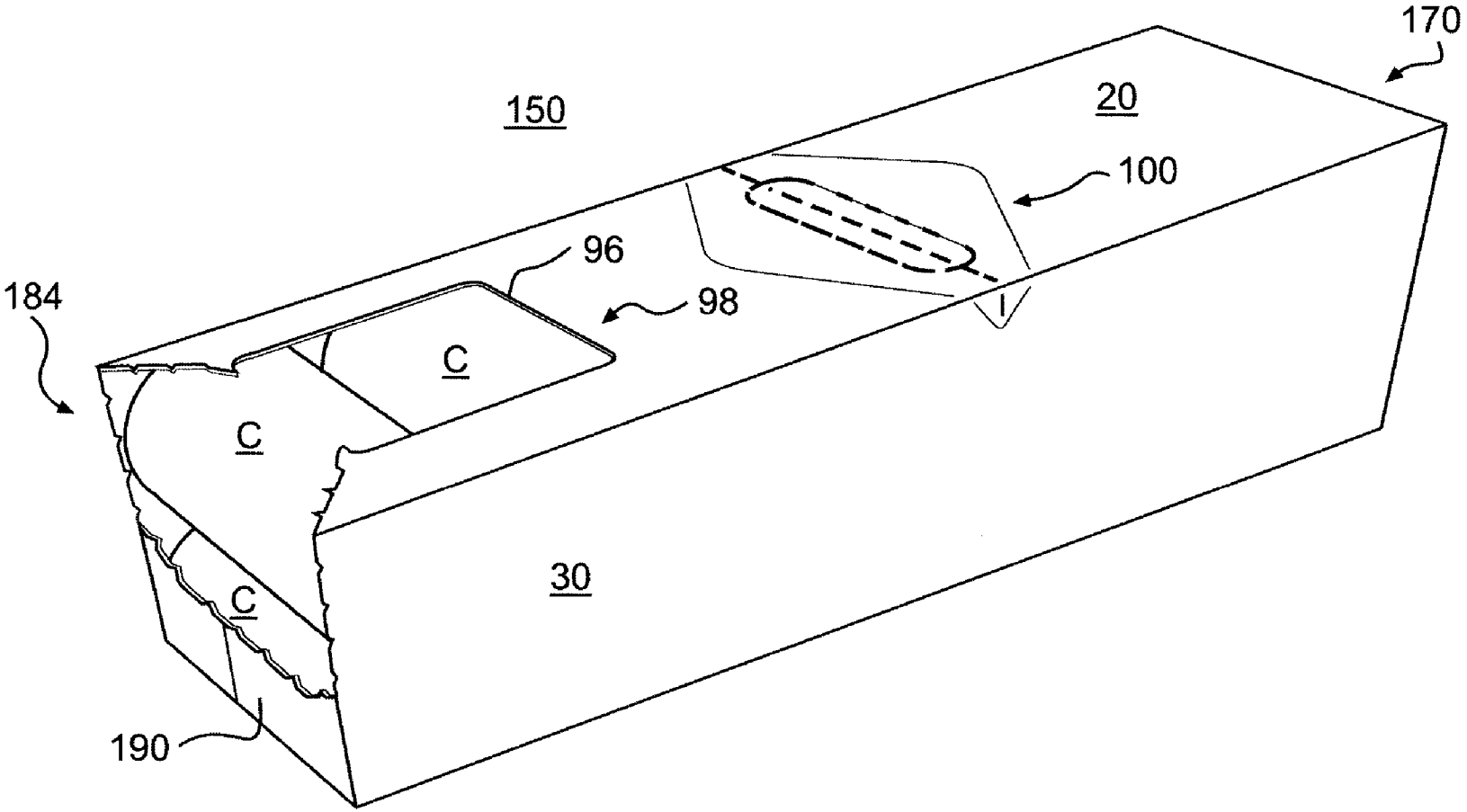
FIG. 5 illustrates the dispenser opened with a dispenser section separated from the remainder of the carton.

An exemplary method of opening of the carton dispenser 180 is illustrated in FIGS. 3-5. Referring to FIG. 3, opening of the dispenser 180 may be initiated by inserting a hand through the top panel 20 at the opening 98 and engaging the edge 186 of the dispenser section 182. Referring to FIG. 4, the dispenser section 182 is pulled away at the edge 186 facing the opening 98, and the carton 150 is torn along the tear lines 84, 94, 80, 90.

Referring to FIG. 5 and also to FIG. 1, the carton 150 is fully opened by further tearing along the tear lines 76, 78, 86, 88 to separate the dispenser section 182, leaving a dispenser opening 184 in the carton 150. After separating the dispenser section 182, the remainder of the exiting end panel 160 comprises an end retainer section 190. The dispenser section 182 can be, for example, completely separated from the remainder of the carton 150 as shown in FIG. 5. Alternatively, the dispenser section 182 can be left hingedly attached to the remainder of the carton 150 at the tear lines 76, 86.

Figure 6:
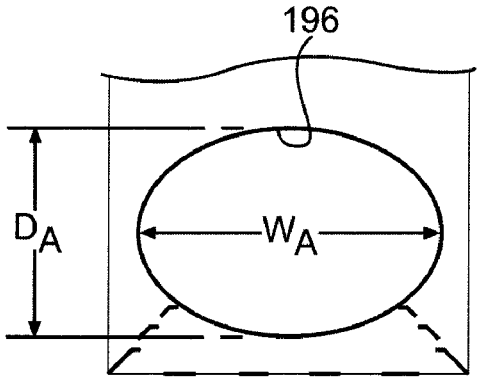
FIGS. 6-8 illustrate alternative embodiments of apertures.
Figure 7:
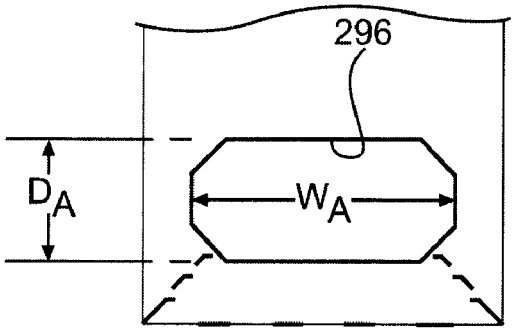
Figure 8:
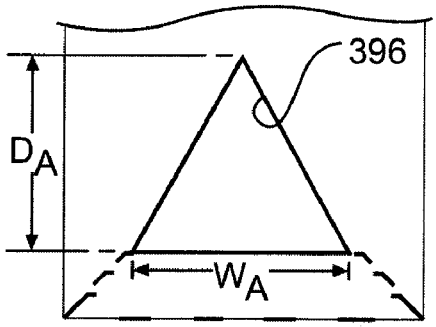

FIGS. 6-8 are partial top plan views of carton top panels having alternative apertures. FIG. 6 illustrates an oval aperture 196 disposed adjacent to or adjoining a dispenser pattern. FIG. 7 illustrates an eight-sided aperture 296. FIG. 8 illustrates a triangular aperture 396. Any of the apertures 196, 296, 396 can be incorporated into a carton blank as illustrated in FIG. 1.

Referring to FIGS. 1 and 6-8, the viewing apertures according to the present embodiments may have a width $W_A$ that corresponds to a widest point of the aperture in the top panel, and a depth $D_A$ that corresponds to the largest depth of the aperture across the top panel. In one embodiment, the width $W_A$ can be at least 20% of the width of the width $W_1$ of the top panel, and the depth $D_A$ is at least 20% of the width $W_1$. In another embodiment, the width $W_A$ can be at least 40% of the width of the top panel width $W_1$ and the depth $D_A$ at least 40% of $W_1$. In yet another embodiment, the width $W_A$ can be at least 60% of the width of the width $W_1$ and the depth $D_A$ at least 60% of $W_1$.

EXAMPLE 1

A carton 150 according to the embodiment illustrated in FIGS. 1-5 accommodates twelve, 12 fluid ounce, generally cylindrical beverage containers C in a 2×6×1 arrangement. The carton has a height $H_1$ of about 5⅛ in. The width $W_1$ is about 4⅞ in. The viewing aperture 96 has a width $W_A$ of about 2⅞ in., and a depth $D_A$ of about 3 in. The transverse fold lines 21, 31, 41, 51 are crease lines. The lines 76, 78, 80, 84, 86, 88, 90, 94 are tear lines formed from spaced 100% cuts.

In the above embodiments, the exemplary carton is described as accommodating twelve 12-ounce cylindrical beverage containers C in a 2×6×1 configuration. Other arrangements of containers, packages, articles, and other items, however, can be accommodated within a carton constructed according to the principles of the present invention. For example, a carton constructed according to the principles of the present invention would also function satisfactorily if the carton were sized and shaped to hold articles in other configurations, such as 4×3×1, 3×6×1, 2×4×1, 2×5×1, 4×6×1, 4×6×1, etc., and multi-tier variations of the aforementioned configurations. The dimensions of the exemplary blank may also be altered, for example, to accommodate various container forms. For example, 16-ounce petaloid bottles may be accommodated within cartons constructed according to the principles of the present invention.

In accordance with the exemplary embodiments, the blank may be constructed of paperboard. The blank can also be constructed of other materials, such as cardboard, hard paper, SUS board, or any other material having properties suitable for enabling the carton to function as described above. The blank can also be laminated to or coated with one or more sheet-like materials at selected panels or panel sections.

The blank according to the present invention can be, for example, formed from coated materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank.

For purposes of the description presented herein, the term "line of disruption" can be used to generally refer to either a cut line, a tear line, a crease line, a score line, or a fold line formed in the material (or overlapping and/or sequential combinations of at least one cut line, crease line, score line, tear line, or fold line). A breachable line of disruption is a line of disruption that is intended to be breached during ordinary use of the carton. An example of a breachable line of disruption is a tear line.

In accordance with the above-described embodiments of the present invention, a fold line can be any substantially linear, although not necessarily straight, line of disruption or other form of weakening that facilitates folding therealong. More specifically, but not for the purpose of narrowing the scope of the present invention, fold lines include: score lines; cuts that extend partially into a material along the desired line of weakness, and/or a series of cuts that extend partially into and/or completely through the material along the desired line of weakness; and various overlapping and/or sequential combinations of these features.

In the present specification, a "panel" or "flap" need not be flat or otherwise planar. A "panel" or "flap" can, for example, comprise a plurality of interconnected generally flat or planar sections.

The above embodiment may be described as having one or panels adhered together by glue during erection of the carton embodiment. The term "glue" is intended to encompass all manner of adhesives used to secure carton panels in place.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A carton and a plurality of cylindrical containers accommodated in an interior of the carton, the carton comprising:

a bottom panel;

a first side panel connected along a first fold line to a first side panel end flap;

a second side panel connected along a second fold line to a second side panel end flap;

a top panel connected along a third fold line to a top panel end flap;

the top panel connected along a fourth fold line to the first side panel and connected along a fifth fold line to the second side panel;

the third fold line and the fourth fold line intersecting to form a first corner in the top panel;

the third fold line and the fifth fold line intersecting to form a second corner in the top panel;

a dispenser pattern comprising breachable lines of disruption and defining a dispenser section in the carton; a first breachable line of disruption extending along the first fold line; a second breachable line of disruption extending along the second fold line; and an aperture in the top panel, the dispenser pattern further comprising a third breachable line of disruption extending in the top panel from the aperture to the first corner, a fourth breachable line of disruption extending in the top panel from the aperture to the second corner, the aperture in the top panel allowing one or more of the cylindrical containers in the carton interior to be viewed from an exterior of the carton prior to removal of the dispenser section.

2. The carton of claim 1, wherein the aperture is defined entirely in the top panel.

3. The carton of claim 2, wherein the dispenser pattern is defined in the first side panel end flap and in the second side panel end flap.

4. The carton of claim 3, including a handle in the top panel.

5. The carton of claim 1, wherein the aperture has a depth that is at least twenty percent of a width of the top panel and a width that is at least twenty percent of the width of the top panel.

6. The carton of claim 1, wherein the carton is substantially parallelepipedal.

7. The carton of claim 6, wherein the aperture has a depth that is at least twenty percent of a width of the top panel and a width that is at least twenty percent of the width of the top panel.

8. The carton of claim 1, wherein the aperture has a depth that is at least forty percent of a width of the top panel and a width that is at least forty percent of the width of the top panel.

9. The carton of claim 8, wherein a handle is included in the top panel.

10. A carton blank, comprising:

a bottom panel;

a first side panel connected along a first fold line to a first side panel end flap;

a second side panel connected along a second fold line to a second side panel end flap;

a top panel connected along a third fold line to a top panel end flap;

the top panel connected along a fourth fold line to the first side panel and connected along a fifth fold line to the second side panel;

the third fold line and the fourth fold line intersecting to form a first corner in the top panel;

the third fold line and the fifth fold line intersecting to form a second corner in the top panel;

a dispenser pattern comprising breachable lines of disruption and defining a dispenser section in the blank; a first breachable line of disruption extending along the first fold line; a second breachable line of disruption extending along the second fold line: and an aperture in the top panel adjacent the dispenser pattern, a third breachable line of disruption extending in the top panel from the aperture to the first corner, a fourth breachable line of disruption extending in the top panel from the aperture to the second corner, wherein the aperture has a depth that is at least twenty percent of a width of the top panel and a width that is at least twenty percent of the width of the top panel.

11. The blank of claim 10, wherein the dispenser pattern is defined in at least one of the first side panel end flap or the second side panel end flap.

12. The blank of claim 10, wherein the bottom panel and the top panel are substantially rectangular.

13. The blank of claim 10, wherein the width of the aperture is at least forty percent of the width of the top panel.

14. A method of removing cylindrical containers from a carton, the method comprising:

providing a carton comprising:

a bottom panel;

a first side panel connected along a first fold line to a first side panel end flap;

a second side panel connected along a second fold line to a second side panel end flap;

a top panel connected along a third fold line to a top panel end flaw the top panel connected along a fourth fold line to the first side panel and connected along a fifth fold line to the second side panel;

the third fold line and the fourth fold line intersecting to form a first corner in the top panel:

the third fold line and the fifth fold line intersecting to form a second corner in the top panel:

an end panel;

an exiting end panel; the first side panel connected to the exiting end panel along a first fold line;

a dispenser pattern comprising breachable lines of disruption and defining a dispenser section; a first breachable line of disruption extending along the first fold line; a second breachable line of disruption extending along the second fold line: and an aperture in the top panel adjacent the dispenser pattern, a third breachable line of disruption extending in the top panel from the aperture to the first corner, a fourth breachable line of disruption extending in the top panel from the aperture to the second corner, wherein the aperture has a depth that is at least twenty percent of a width of the top panel and a width that is at least twenty percent of the width of the top panel, and wherein at least one of the articles is visible through the aperture;

accessing an edge of the dispenser section at the aperture;

pulling the dispenser section at the aperture to separate the dispenser section along the breachable lines of disruption to pull the dispenser section at least partially away from a remainder of the carton to create a dispenser opening; and removing a container from the carton through the dispenser opening.

15. The method of claim 14, wherein the aperture is defined entirely in the top panel.

16. The method of claim 14, wherein the carton is substantially parallelepipedal.

17. The method of claim 14, wherein the width of the aperture is at least forty percent of the width of the top panel.

* * * * *